US006435251B1

(12) United States Patent
Tortorella, Jr.

(10) Patent No.: US 6,435,251 B1
(45) Date of Patent: Aug. 20, 2002

(54) HOPPER VENT

(75) Inventor: Frank J. Tortorella, Jr., Park Ridge, IL (US)

(73) Assignee: International Product Supply, Schiller Park, IL (US)

( * ) Notice: Subject to any disclaimer, the term of this patent is extended or adjusted under 35 U.S.C. 154(b) by 0 days.

(21) Appl. No.: 09/641,440

(22) Filed: Aug. 17, 2000

(51) Int. Cl.[7] ..... E06B 3/32
(52) U.S. Cl. ..... 160/93; 49/400
(58) Field of Search ..... 160/93, 92, 94, 160/44, 369, 371, 405; 49/400, 408, 391, 390, 68

(56) References Cited

U.S. PATENT DOCUMENTS

| | | | | | |
|---|---|---|---|---|---|
| 1,780,492 | A | * | 11/1930 | Malm | 160/44 |
| 2,185,888 | A | * | 1/1940 | Donahoe | 160/92 |
| 2,203,753 | A | * | 6/1940 | Strandt | 160/44 |
| 2,733,487 | A | * | 2/1956 | Hauck | 160/44 |
| 2,889,591 | A | * | 6/1959 | Pratt | 160/92 |
| 3,091,008 | A | * | 5/1963 | Riegelman | 160/44 |
| 3,344,557 | A | * | 10/1967 | Lewin | 160/92 |
| 4,125,141 | A | * | 11/1978 | Stillwell | 160/44 X |
| 4,363,350 | A | * | 12/1982 | Beckerer | 160/92 |
| 4,502,260 | A | * | 3/1985 | Machler | 160/369 X |
| 5,315,798 | A | * | 5/1994 | Zarwell | 52/202 |
| 5,511,352 | A | * | 4/1996 | Sholton | 52/306 |
| 5,675,948 | A | | 10/1997 | Boesch | 52/209 |
| 5,784,839 | A | * | 7/1998 | La Vanway | 52/204.1 |

* cited by examiner

*Primary Examiner*—David M. Purol
(74) *Attorney, Agent, or Firm*—McAndrews, Held & Malloy, Ltd.

(57) ABSTRACT

An improved hopper vent is provided which includes many novel features. The hopper vent includes a removable sash window that is removable from the interior side of the hopper vent. The removable sash window is spring loaded into the frame of the hopper vent and is injection molded for easy manufacture. The hopper vent also includes a removable screen which is also removable from the interior side of the hopper vent. The hopper vent also includes a pivot system to allow the removable sash window to pivot open instead of rotating open like in previous, hinge-based systems. Also, the hopper vent includes a dam system which prevents water from draining to the interior of the hopper vent. The dam system includes a front riser to prevent water from draining to the interior of the hopper vent and a drain, such as weep holes or a gap between the frame and the screen of the hopper vent, to allow water to drain to the exterior of the hopper vent. The removable sash window of the hopper vent is also fixedly positionable at a plurality of different openings.

14 Claims, 11 Drawing Sheets

HOPPER VENT

BACKGROUND OF THE INVENTION

The present invention generally relates to an improved hopper vent. More particularly, the present invention relates to an improved hopper vent including many novel features such as a pivoting, removable and fixedly positionable sash window, a removable screen, and a dam system.

Hopper vents, also commonly known as ventilators, have been extensively used for some time. For example, a hopper vent may be typically employed as part of a glass block window in a residential, commercial, or industrial structure. The typical hopper vent includes a window portion enclosed in a frame portion. The frame portion is typically in contact with the surrounding glass block window. The window portion is typically affixed to the frame and may open and close within the frame. The typical hopper vent also includes a screen covering the window portion, for example, to prevent insects from entering the hopper vent when the window portion of the hopper vent is open.

Typically, the typical hopper vent is comprised of extruded metal or vinyl. The screen is typically fastened to the hopper vent from the outside. The window portion of the hopper vent is typically affixed to the frame with a hinge. The hinge is typically fastened to both the window portion and the frame with metal screws or rivets and is not meant to be removed. The hopper vent may also include a window lock to lock the window portion to the frame and thus lock the hopper vent closed. Similar to the hinge, the window lock is typically also affixed to the window portion with metal screws.

U.S. Pat. No. 5,675,948 entitled "Insulated Ventilator for Glass Block Window" (the '948 patent) illustrates a typical, latest generation, ventilator. FIG. 1 of the '948 patent illustrates a typical installation of a ventilator 12 in a glass block window 10.

Referring to FIG. 6 and column 5 of the description, the invention of the '948 patent also provides for the removal of the window assembly 56 mounted in the sash frame 54. However, the window assembly 56 is merely an insert in the sash frame 54 and is further described at column 5, line 47 to column 4, line 7. The window assembly 56 may be removed and replaced if broken, however, the sash frame 54 itself is not generally removable.

Also, as shown in FIG. 1, the ventilator includes a screen assembly 22 affixed over the opening of the ventilator 12 by exterior screws at each end of the screen. FIG. 4 more clearly illustrates that the screen 22 is fastened to the outside of the ventilator 12 by screws 132 and is not removable from the inside Additionally, as shown in FIG. 6, the sash frame 54 is affixed to the frame 18 by hinge members 66, 68 which allow the sash frame 54 to rotate opened and closed. The sash frame 54 is not fixably positioned at any open position, but instead may rely on the innately unreliable friction in the hinge members 66, 68 to fix the position of the sash frame 54 at a desired open orientation.

Also, typically, when the ventilator 12 is installed in an exterior wall, liquid such as rain water may enter the ventilator 12. Once it enters the ventilator 12, rain water may drain to the interior of the ventilator 12, if the sash frame 54 is open. Although the ventilator 12 includes a riser at its interior edge, water may accumulate and overflow the riser to drain into the interior of the ventilator 12.

Also, as shown in FIG. 3, the ventilator 12 includes a latch 70 that has been fastened to the sash frame 54 by metal screws and serves to latch the sash frame 54 to the frame 18.

Additionally, the ventilator 12 relies on a single seal 100 between the sash frame 54 and the frame 18. With extensive use or extreme temperature, the seal 100 may become worn and no longer be able to provide sealing.

The prior art, as exemplified by the invention of the '948 patent, suffers from many drawbacks. For example, although the window assembly 56 is removable, the sash frame 54 is not. Because the sash frame 54 is not removable, access to the interior of the ventilator 12 and to the screen 22 is limited. Also, cleaning the sash frame 54 and the screen 22 is difficult. Also, the sash frame 54 relies on hinge members 66, 68 to open and close. Hinge members 66, 68 may be susceptible to adverse effects such as freezing and oxidation that may prevent the ventilator 12 from being operated. Additionally, the screen 22 is not generally removable, or only removable from the outside. Consequently, replacing or cleaning the screen 22 may require the use of a ladder or other equipment. Also, as mentioned above, water may drain into the interior of the ventilator 12. In addition, the ventilator 12 relies on a single seal 100 which may become breached by time or temperature extremes. Also, the ventilator 12 may be difficult to position in an intermediate position between open and closed because of the ventilator's 12 reliance on the hinge members 66, 68. Additionally, the ventilator 12 includes a latch 70 attached to the sash frame 54. The attached latch 70 may be expensive to manufacture or may separate from the sash frame 54. Also, the ventilator 12 is extruded and then welded together (col. 2, lines 42–47), a rather expensive and lengthy manufacturing process. Finally, the joins between the frame elements may be imperfect, thus allowing leakage of air or water.

An improved hopper vent providing, for example, greater sealing, durability, cost-effectiveness, and ability to be cleaned is very commercially desirable. Thus, a need exists for an improved hopper vent to remedy the many drawbacks of the prior art.

SUMMARY OF THE INVENTION

The present invention comprises an improved hopper vent including many novel features. These features include: a sash window that is removable from the interior or exterior side of the hopper vent, fixedly positionable at a plurality of different openings, spring loaded into the frame of the hopper vent and is injection molded for easy manufacture; a screen which is also removable from the interior side of the hopper vent; a pivot system allowing the sash window to pivot open instead of rotating open like in previous, hinge-based systems; and a dam system including a front riser to prevent water from draining to the interior of the hopper vent and a drain, such as weep holes or a gap between the frame and the screen of the hopper vent, to allow water to drain to the exterior of the hopper vent.

These and other features of the present invention are discussed or apparent in the following detailed description of the preferred embodiments of the invention.

DETAILED DESCRIPTION OF THE PREFERRED EMBODIMENTS

In describing a preferred embodiment of the present invention as illustrated in the accompanying drawings, specific terminology, such as top, bottom, left, right, interior and exterior, for example, will be utilized for the sake of clarity. However, the invention is not intended to be limited to the specific terms so selected, and it is to be understood that each specific term includes a multitude of equivalents.

Figure 1:
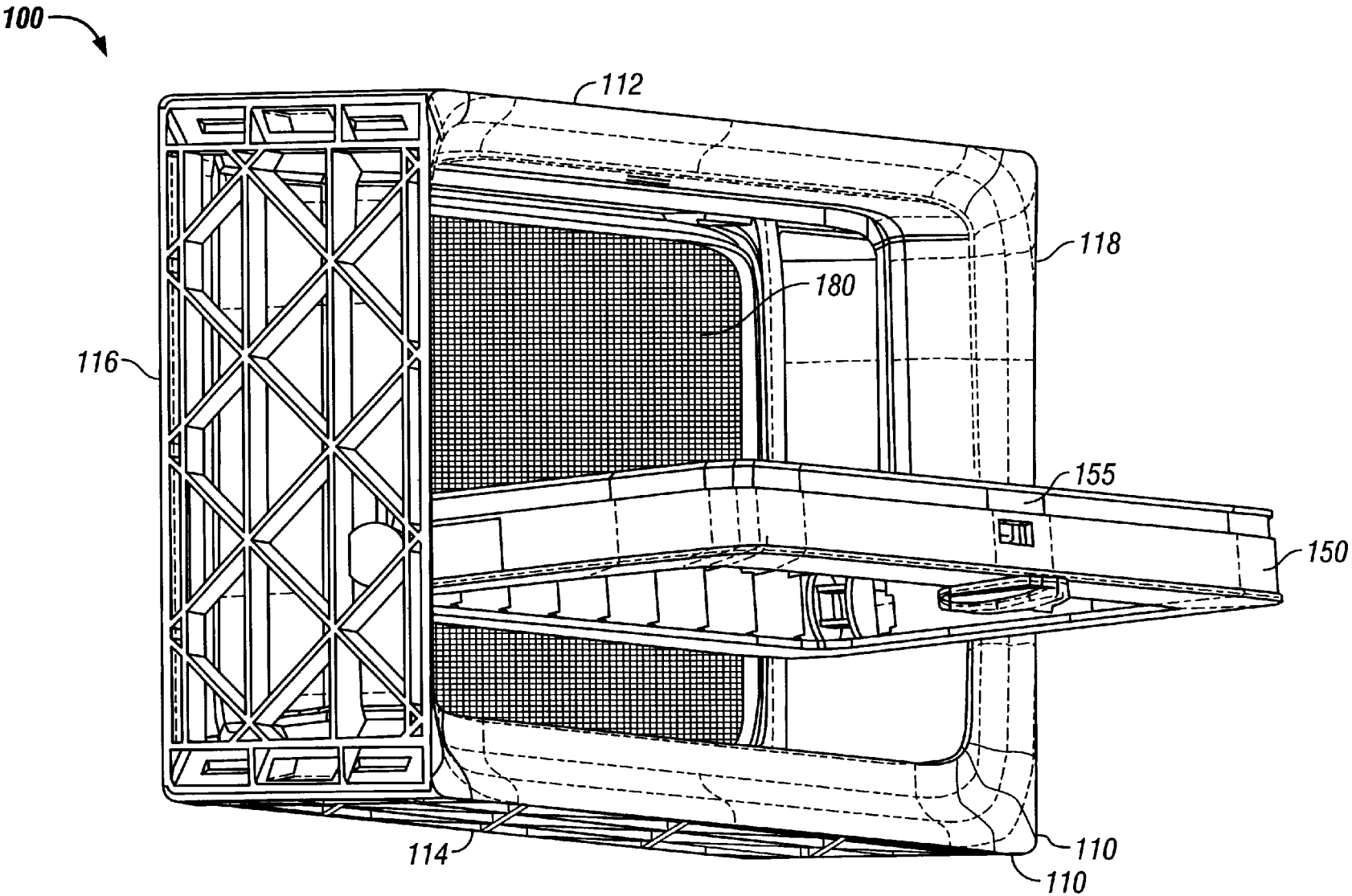
FIG. 1 illustrates a perspective view of an improved hopper vent according to a preferred embodiment of the present invention.

FIG. 1 illustrates an improved hopper vent 100 according to a preferred embodiment of the present invention. The hopper vent 100 includes a frame 110, a removable sash window 150, and a removable screen 180. The frame 110 includes four elements, a top frame element 112, a bottom frame element 114, a left side frame element 116, and a right side frame element 118. The removable sash window 150 includes a window lock 155.

Figure 2:
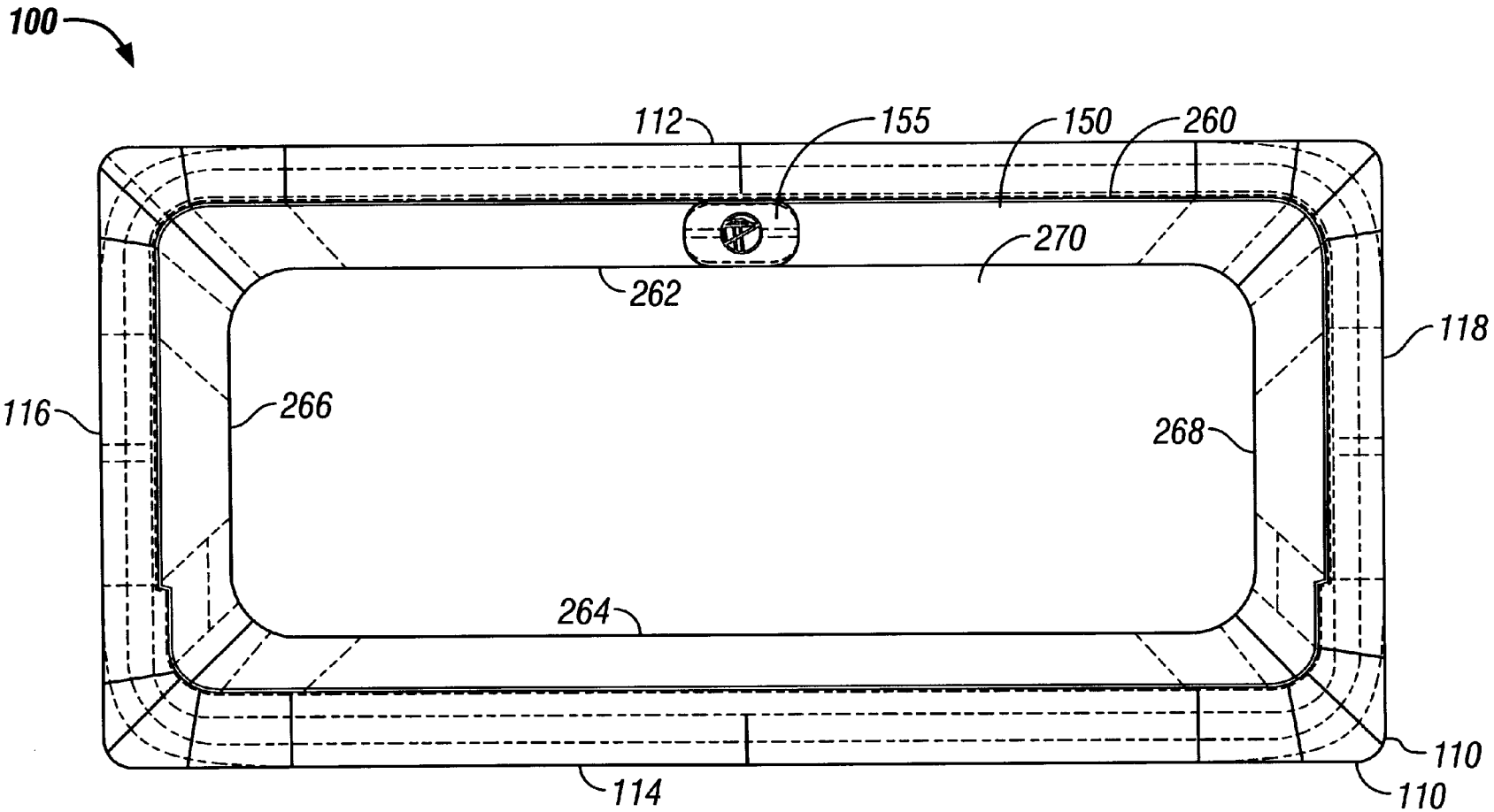
FIG. 2 illustrates an interior view of the improved hopper vent according to a preferred embodiment of the present invention.
Figure 3:
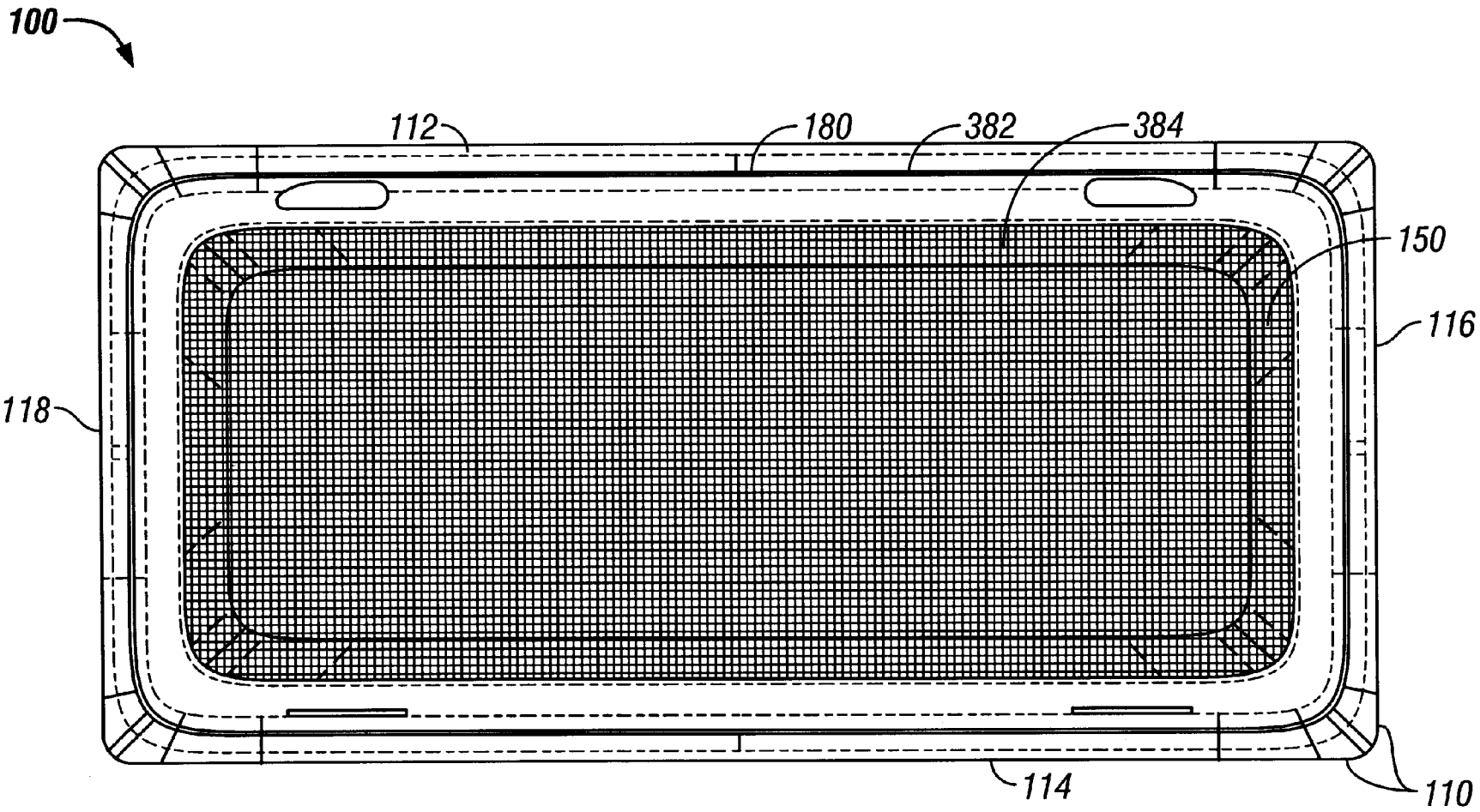
FIG. 3 illustrates an exterior view of the improved hopper vent according to a preferred embodiment of the present invention.

In practice, the present invention typically may be included as part of a glass block window typically located as part of an exterior wall of a structure and separating the interior of the structure from the exterior of the structure. The glass block window, and thus also the present invention, may then be understood to include an interior side, viewable from inside the structure, and an exterior side viewable from outside the structure. FIG. 2 illustrates the hopper vent 100 as seen from the interior side. FIG. 3 illustrates the hopper vent 100 as seen from the exterior side. References, such as left and right, for example, are described from the perspective of an interior side point of view.

As further described below, the removable sash window 150 of the hopper vent may be opened and closed from the interior side of the hopper vent 100 or positioned in any of multiple open positions. The removable sash window 150 may also be positioned at one of several open positions. The window lock 155 may be used to lock the removable sash window 150 in its closed position. Also, the removable sash window 150 may be removed from the frame 110 from the interior side, for example, for cleaning. Additionally, the removable screen 180 may be removed from the frame 110 from the interior side, for example, for cleaning. FIG. 1 shows the hopper vent 100 with the removable sash window 150 in its fully open position and with the removable screen 180 installed in the frame 110.

FIG. 2 illustrates an interior view of the improved hopper vent 100 according to a preferred embodiment of the present invention. As visible in FIG. 2, the hopper vent 100 includes the frame 110, the removable sash window 150, and the window lock 155. As described above, the frame 110 includes the top frame element 112, the bottom frame element 114, the left side frame element 116, and the right side frame element 118. In addition to the window lock 155, the sash window 150 includes a transparent insert 270 and a window frame 260 including four elements, a top window frame element 262, a bottom window frame element 264, a left side window frame element 266, and a right side window frame element 268.

FIG. 2 shows the removable sash window 150 in its closed position. That is, the removable sash window 150 has been pivoted substantially into the plane of the frame 110 and the edges of the removable sash window 150 are substantially in contact with the frame 110. The removable sash window 150 pivots open and closed between a fully open position as shown in FIG. 1 and a fully closed position as shown in FIG. 2. As further described below, the removable sash window 150 may also be opened and positioned in any of a number of partially open positions. FIG. 2 also shows the window lock 155 set in the removable sash window 150 in its locked position, as further described below.

FIG. 3 illustrates an exterior view of the improved hopper vent 100 according to a preferred embodiment of the present invention. As visible in FIG. 3, the hopper vent 100 includes the frame 110, the removable sash window 150, and the removable screen 180. As described above, the frame 110 includes the top frame element 112, the bottom frame element 114, the left side frame element 116, and the right side frame element 118. Additionally, the removable screen 180 includes a screen frame 382 and a screen mesh 384. As visible in FIG. 3, a portion of the removable sash window 150 may be seen through the screen mesh 384. FIG. 3 shows the removable screen 180 in its installed position and the removable sash window 150 in its closed position.

As illustrated generally above with reference to FIGS. 1–3 and as further described below, a preferred embodiment of the present invention includes many novel elements. Some of these novel elements include: 1) a removable interior sash window, especially wherein the removable interior sash window is injection molded, spring loaded into an exterior frame, and includes locking hardware on the sash window; 2) a sash window that employs a pivot system to open instead of a hinge to rotate open; 3) a removable screen that is removable from the interior for cleaning, for example; 4) a built-in dam system including an interior riser at the inside edge of the bottom frame to prevent water from flowing inside and weep holes to allow water to flow outside; 5) a dual-sealing sash window, for example, having seals on the front and back of the sash window that seal to the top and bottom of the frame; 6) a perimeter compression seal around the sash window, for example, a foam rubber lining which cooperates with a groove on the sash window to form a compression seal; 7) a sash window with multiple locking positions so that the window may be opened and locked to various positions; 8) a curved lower interior ledge to prevent accumulation of dirt and provide for easy cleaning; 9) an interior lock fashioned as part of the sash window instead of attached to the exterior frame; 10) an injection molded hopper vent that snaps together for easy manufacture and assembly; and 11) interlocking seals at the front and back comers of the exterior frame to provide better sealing between frame elements. Each of these elements is further described below.

Figure 4:
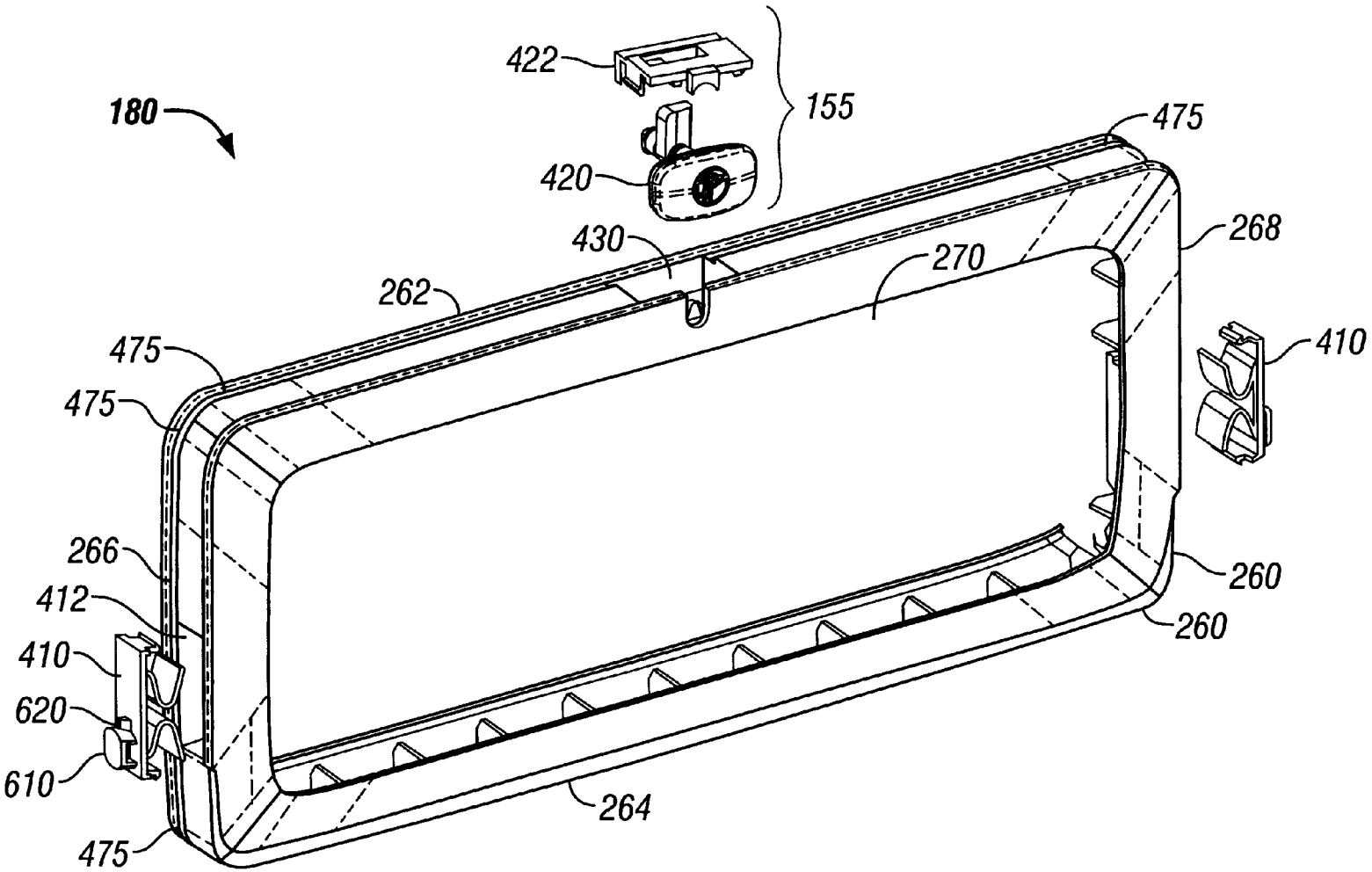
FIG. 4 illustrates an interior view of the removable sash window according to a preferred embodiment of the present invention.

FIG. 4 illustrates an interior view of the removable sash window 150 according to a preferred embodiment of the present invention. As shown in FIG. 4, the removable sash window 150 includes the window frame 260, the transparent insert 270, the window lock 155, two window pivots 410, and a window seal groove 475. The window frame 260 includes the top window frame element 262, the bottom window frame element 264, the left side window frame element 266, and the right side window frame element 268. The window lock 155 includes a rotating user fob 420 and a lock casing 422. The top window frame element 262 includes a window lock insert slot 430. The left side window frame element 266 and the right side window frame element 268 each include a window pivot insert slot 412.

As further described below, the removable sash window 150 is formed in a number of steps. First, the four frame elements 262–268 are assembled around the transparent insert 270, preferably by snapping the frame elements 262–268 together. Next, the window pivots 410 are installed into the window pivot insert 412 of both the left side window frame element 266 and the right side window frame element 268. Then, the window lock 155 is installed into the window lock insert 430 of the top window frame element 262.

The removable sash window 150 also includes a window seal groove 475. The window seal groove 475 extends completely around the perimeter of the window frame 260 as shown. As further described below, the window seal groove 475 receives a compression sealant 975, for example foam rubber, from the frame 110. The seal groove 475 cooperates with the compression sealant 975 to completely seal the perimeter of the removable sash window 150 to the frame 110.

Figure 5:
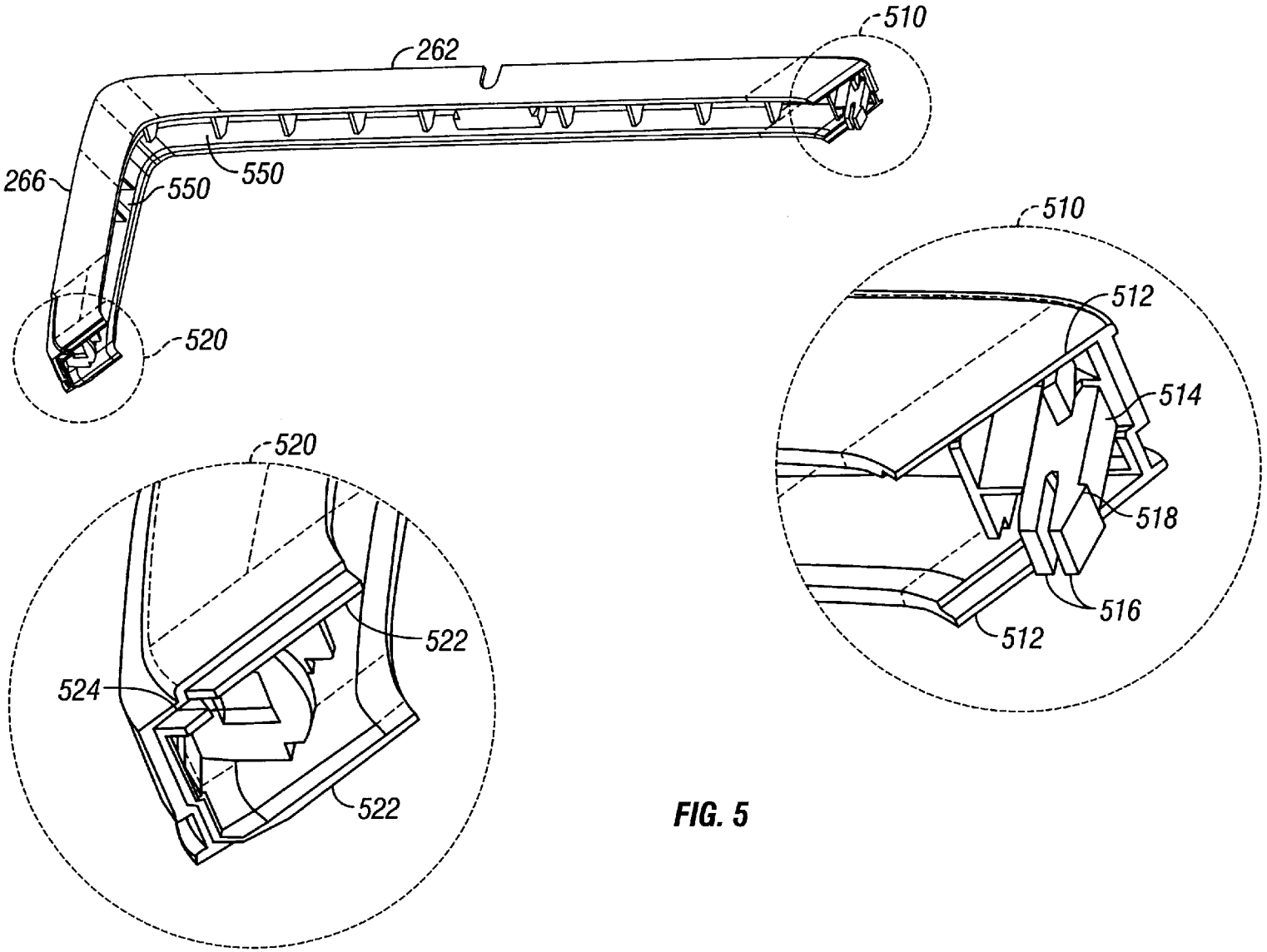
FIG. 5 illustrates the top window frame element and the left side window frame element according to a preferred embodiment of the present invention.

FIG. 5 illustrates the top window frame element 262 and the left side window frame element 266 according to a preferred embodiment of the present invention. FIG. 5 shows a male connection 510 and a female connection 520. The male connection 510 includes an exterior seal wall 512 and a connection member 514 including two prongs 516 and a backstop notch 518. The female connection 520 includes an interior seal wall 522 and a connection aperture 524. Additionally, as shown in FIG. 5, the frame elements 262–268 include a transparent insert slot 550.

Each of the frame elements 262–268 is preferably composed of an injection molded plastic form. The individual frame elements 262–268 are joined together in four locations to form the window frame 260. That is, the window frame elements 262-268 are joined between 1) the top 262 and left side 266 (as shown in FIG. 5), 2) the left side 266 and bottom 264, 3) the bottom 264 and right side 268, and 4) the right side 268 and top 262. At each connection between two window frame elements 262–268, one of the window frame elements 262–268 includes a male connection 510 and the other window frame element 262–268 includes a female connection 520. Each of the connections between window frame elements 262–268 is substantially similar to the mechanism illustrated in FIG. 5.

To connect two window frame elements 262–268, the window frame elements are snapped together. That is, the connection member 514 of the male connection 510 is introduced into the connection aperture 524 of the female connection 520. As the connection member 514 is introduced into the connection aperture 524, the two prongs 516 are forced together until the backstop notch 518 passes through the connection aperture 524. Once the backstop notch 518 passes through the connection aperture 524, the two prongs 516 are no longer forced together and the backstop notch engages the connection aperture 524 to lock the two window frame elements 262–268 together. The interior sealing wall 522 and exterior sealing wall 512 act to seal the window frame 260, for example, to minimize the introduction of dirt or moisture into the window frame.

Before the fourth of the window frame elements 262–268 is joined to form the window frame 260, the transparent insert 270 is introduced into the transparent insert slot 550. The final frame element 262–268 is then joined to the window frame 260, both locking to the other frame elements and sealing the transparent insert 270 into the transparent insert slot 550. The transparent insert 270 may be any transparent material, but is preferably a solid panel of glass or plastic.

Figure 6:
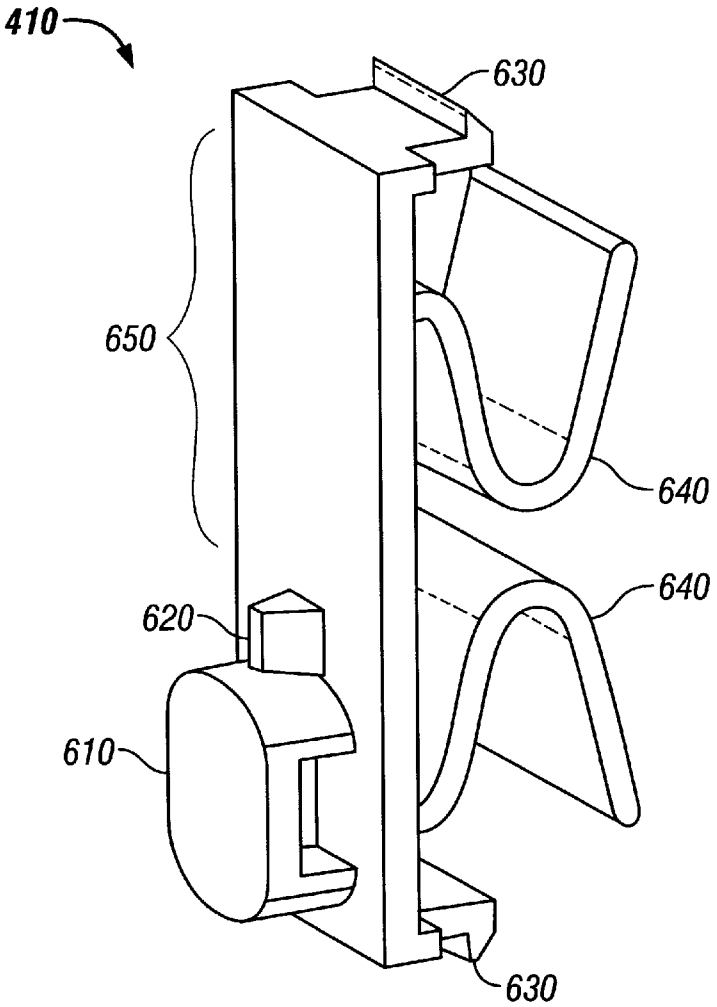
FIG. 6 illustrates the window pivot according to a preferred embodiment of the present invention.

FIG. 6 illustrates the window pivot 410 according to a preferred embodiment of the present invention. The window pivot 410 includes a pivot nub 610, a window positioning nub 620, a pivot installment notches 630, a pivot bias springs 640, and a pivot nub disengage location 650. In practice, the window pivot 410 is installed into the window pivot insert slot 412 of either the left side window frame element 266 or the right side window frame element 268.

To install the window pivot 410, the window pivot 410 is introduced into the window pivot insert slot 412. As the window pivot 410 is introduced into the window pivot insert slot 412, the edges of the window pivot insert slot 412 bias the pivot installment notches 630 together until the installment notches 630 pass through the edges of the window pivot insert slot 412. Once the installment notches 630 pass through the window pivot insert slot 412, the installment notches 630 are no longer forced together and the installment notches engage the window pivot insert slot 412 to lock the window pivot 410 into the window pivot insert slot 412. The pivot bias springs 640 bias the window pivot 410 outward, away from the window pivot insert slot 412, for example, to engage the installment notches 630 with the edges of the window pivot insert slot 412.

As further described above and below, in operation, the removable sash window 150 is installed within the frame 110 and pivots between open and closed positions. To allow the removable sash window 150 to pivot, the pivot nub 610 of the window pivot 410 is introduced into a pivot slot 920 in the frame 110 as further described below with reference to FIG. 9. The removable sash window 150 may then pivot around the pivot nub 610 of the window pivot 410.

Additionally, as further described below, as the removable sash window 150 is pivoted open and closed, the removable sash window 150 may be positioned at several positions. The removable sash window 150 may be positioned at a position by introducing the positioning nub 620 into one of the positioning slots 950 in the frame 110 as further described below with reference to FIG. 9. For example, as the removable sash window 150 is pivoted, the positioning nub 620 pivots along with the removable sash window 620. The positioning nub 620 is biased outward, away from the window pivot insert slot 412 and toward the frame 110 surrounding the removable sash window 150 by the pivot bias springs 640. As the removable sash window 150 is pivoted and the positioning nub enters one of the positioning slots 950, the pivoting of the removable sash window 150 is arrested and the removable sash window 150 remains open to the position determined by the positioning slot 950.

The positioning nub 620 is generally triangular in cross-section. The triangular cross-section, coupled with the bias provided by the pivot bias springs 640, allow a user to continue pivoting the removable sash window 150 if sufficient force is applied by the user. For example, once the positioning nub 620 engages a positioning slot 950 and the pivoting of the removable sash window 150 is arrested, the user may continue to pivot the removable sash window 150 when the user applies sufficient force to pivoting the removable sash window 150 to overcome the outward bias of the pivot bias springs 640. When the user applies sufficient force to overcome the outward bias of the pivot bias springs 640, the edge of the positioning slot 950 forces the positioning nub 620 (and typically the entire window pivot 410) inward into the pivot insert slot 412 for a small distance, substantially the height of the positioning nub 620. As the removable sash window 150 is pivoted further and another positioning slot 950 appears, the pivot bias springs 640 bias the positioning nub 620 away from the pivot insert slot 412 and into the positioning slot 950. At all times, the pivot nub 610 remains engaged into the pivot slot 920 because the pivot nub 610 extends farther outward than the positioning nub 620.

As further described below, the removable sash window 150 may be removed from the frame 110. Typically, to remove the removable sash window 150 from the frame 110, a user presses on the pivot nub disengage location 650 with sufficient force to overcome the bias of the pivot bias springs 640. That is, the user impels the window pivot 410 into the pivot insert slot 412 by pressing on the pivot nub disengage location 650. Unlike the above description with regard to the positioning nub 620 where the window pivot 410 is impelled into the pivot insert slot 412 only to a distance substantially the height of the positioning nub 620, the user continues to impel the window pivot 410 into the pivot insert slot 412 a distance substantially the height of the pivot nub 610, which is larger. By impelling the window pivot 410 into the pivot insert slot 412 a distance substantially the height of the pivot nub 610, the pivot nub 610 is disengaged from the pivot slot 920. Once the pivot nub 610 is disengaged from the pivot slot 920, the removable sash window 150 may be removed from the frame 110.

Figure 7A:
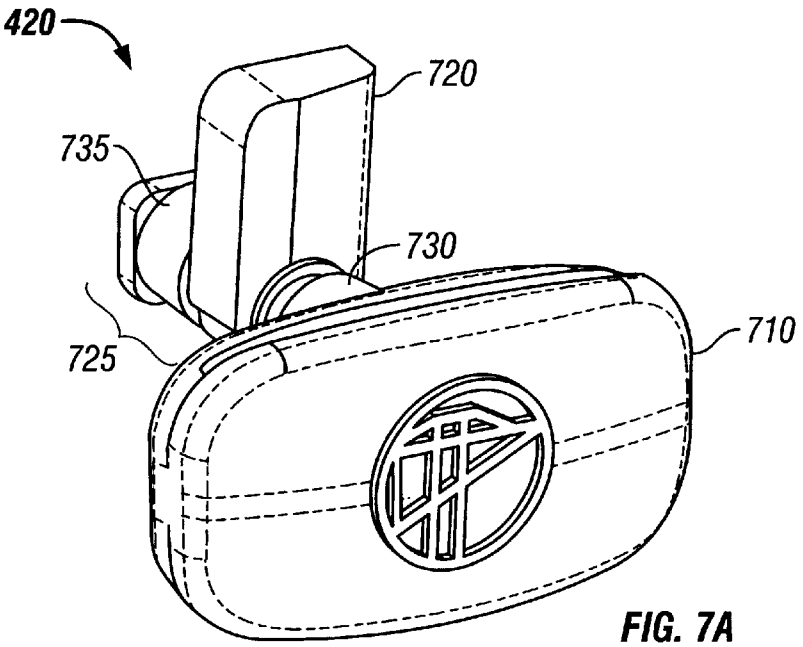
FIG. 7 illustrates the rotating user fob and the lock casing of the window lock according to a preferred embodiment of the present invention.
Figure 7C:
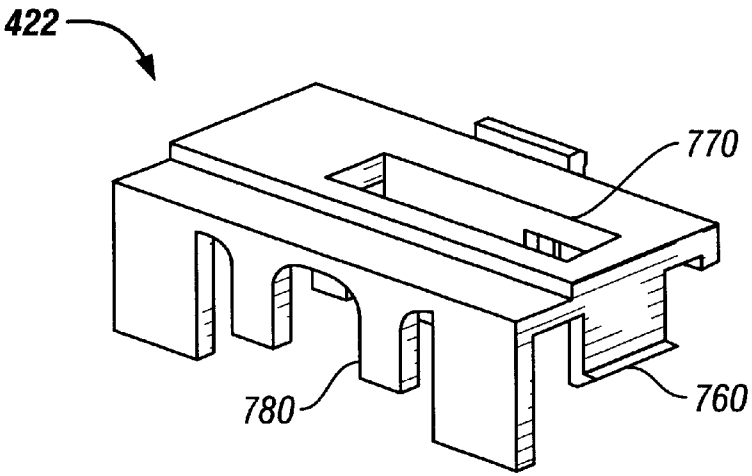
Figure 7B:
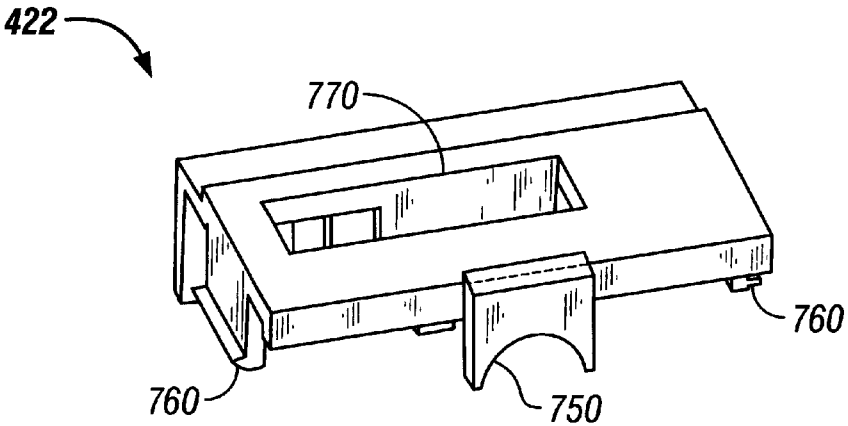

FIG. 7 illustrates the rotating user fob 420 and the lock casing 422 of the window lock 155 according to a preferred embodiment of the present invention. The rotating user fob 420 includes a user fob 710, and a rotating rod 725 including a locking latch 720, a front rotational support 730, and a back rotational support 735. The lock casing 422 includes a front rotational slot 750, a lock casing installment notches 760, a latch aperture 770, and a back rotational slot 780. In practice, the window lock 155 is installed directly into the top window frame element 262 of the removable sash window 150.

The window lock 155 is installed into the top window frame element 262 in two steps. First, the rotating user fob 420 is introduced into the lock insert slot 430 of the top window frame element 262 in such a fashion that the user fob 710 protrudes from the top window frame element 262 as shown in FIGS. 1 and 4. Second, the lock casing 422 is introduced into the lock insert slot 430, trapping the rotating user fob 420 in the lock insert slot 430. As the lock casing 422 is introduced into the lock insert slot 430, the edges of the lock insert slot 430 bias the lock casing installment notches 760 together until the lock casing installment notches 760 pass through the edges of the lock insert slot 430. Once the lock casing installment notches 760 pass through lock insert slot 430, the lock casing installment notches 760 are no longer forced together and the lock casing installment notches 760 engage the lock insert slot 430 to lock the lock casing 422 into the lock insert slot 430.

The lock casing 422 traps the rotating user fob 420 into the lock insert slot 430. The lock casing 422 traps the rotation user fob 420 in such a fashion that the front rotational support 730 of the rotational user fob 420 is positioned inside the front rotational slot 750 of the lock casing. Also, the back rotational support 735 of the rotational user fob 420 is positioned inside the back rotational slot 780. The front rotational 750 and the back rotational slot 780 operate with the lock insert slot 430 to prevent the rotating user fob 420 from being removed from the top window frame element 262, but allow the rotating user fob 420 to rotate about its rotating rod 725.

Figure 10:
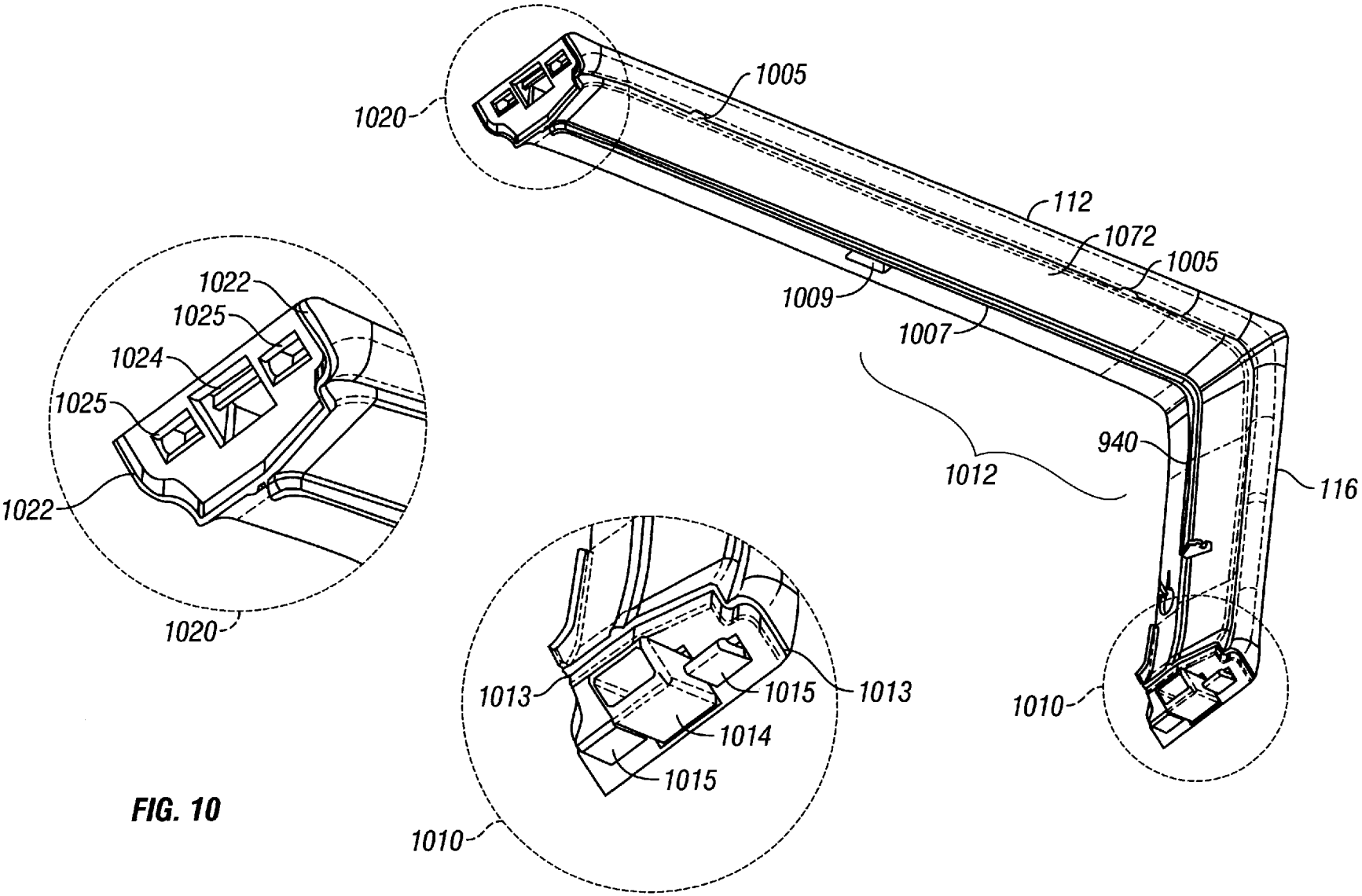
FIG. 10 illustrates the top frame element and the left side frame element according to a preferred embodiment of the present invention.

As the rotating user fob 420 is rotated about its rotating rod 725, the locking latch 720 is extended outward from the lock casing 422 through the latch aperture 770. When the removable sash window 750 is in its fully closed position, as shown in FIG. 2, the locking latch 720, when extended, fits into a locking slot (the locking slot 1009 as shown in FIG. 10 below) in the frame 110 thus locking the removable window sash 150 to the frame 110.

Figure 8:
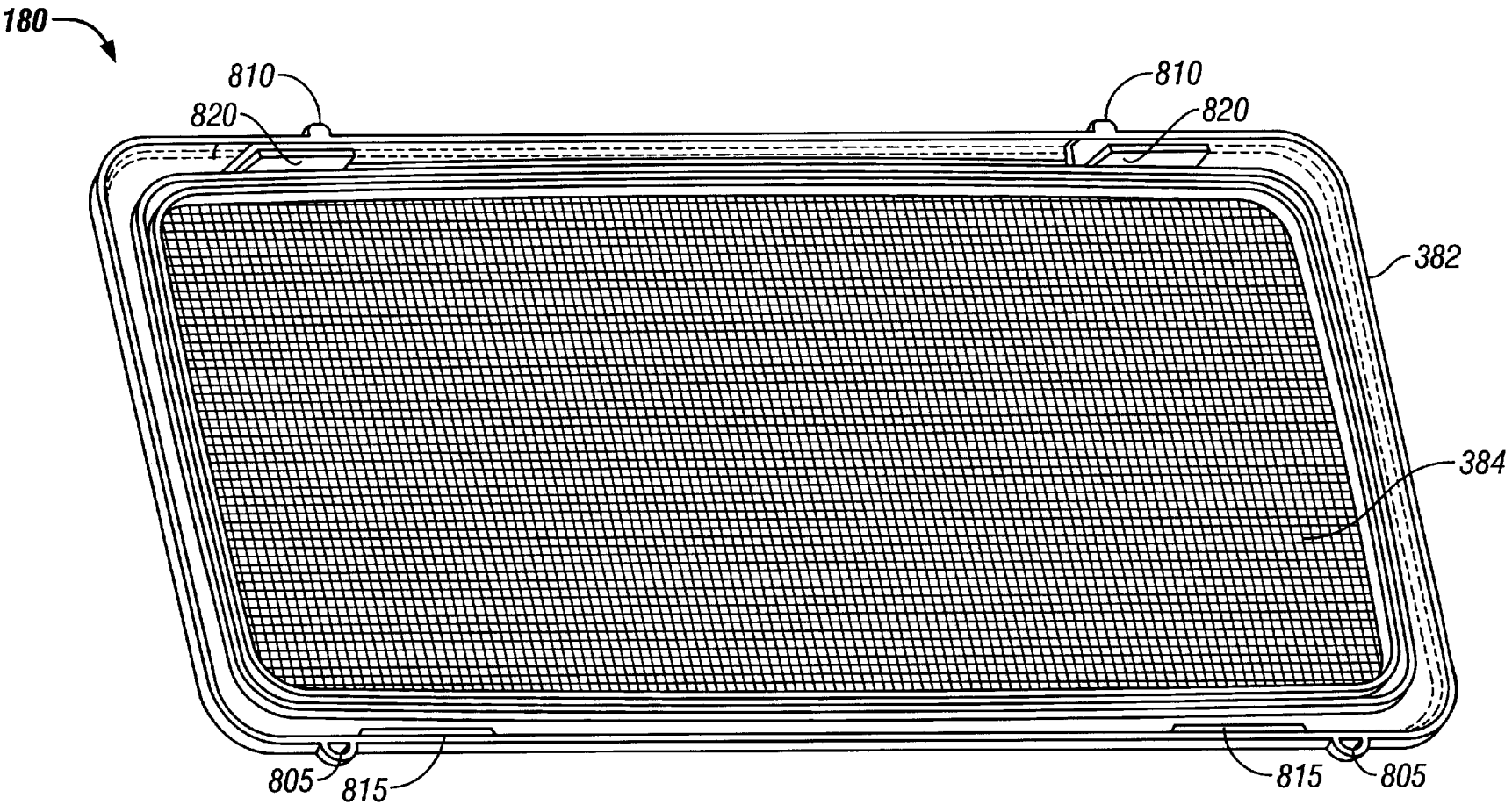
FIG. 8 illustrates an interior view of the removable screen according to a preferred embodiment of the present invention.

FIG. 8 illustrates an interior view of the removable screen 180 according to a preferred embodiment of the present invention. The removable screen 180 includes the screen frame 382 and the screen mesh 384. The screen frame 384 includes bottom screen tabs 805, top screen tabs 810, weep holes 815, and interior screen removal tabs 820.

In practice, the bottom screen tabs 805 are introduced into the bottom screen tab slots 905 shown below in FIG. 9. The top screen tabs 810 are introduced into similar top screen tab slots 1005 shown below in FIG. 10. Once the bottom screen tabs 805 have been introduced into the bottom screen tab slots 905 and the top screen tabs 810 have been introduced into the top screen tab slots, the removable screen 180 has been fixed to the frame 110.

The removable screen 180 may be positioned into or removed from the exterior frame 110 from either the interior side or the exterior side of the hopper vent 100. For example, a user may remove the removable sash 150 and then grasp the interior screen removal tabs 820 and remove the removable screen 180 by pressing down on the interior screen removal tabs 820. Pressing down on the interior screen removal tabs 820 causes the top screen tabs 810 to emerge from the top screen tab slots on the frame 110. The user may then press up on the interior screen removal tabs 820 to cause the bottom screen tabs to emerge from the bottom screen tab slots 905.

The weep holes 815 act as a drain and allow liquids such as water to drain from inside the hopper vent 100 out to the exterior side of the hopper vent 100. For example, rain water may pass through the screen mesh 384 into the hopper vent 100 and accumulate inside the hopper vent 100. The accumulated rainwater may drain out of the hopper vent 100 through the weep holes 815. Alternatively, instead of the employing the weep holes 815 as a drain, the removable screen 180 may be manufactured to provide a gap drain between the removable screen 180 and the frame 110 when the removable screen 180 is installed into the frame 110. Rainwater may then drain out of the hopper vent 100 through the gap drain.

The screen mesh is typically a plastic or metallic mesh composed of horizontally and vertically aligned strands of mesh fiber. Alternatively, the screen mesh may be a single, preformed plastic mesh.

Figure 9:
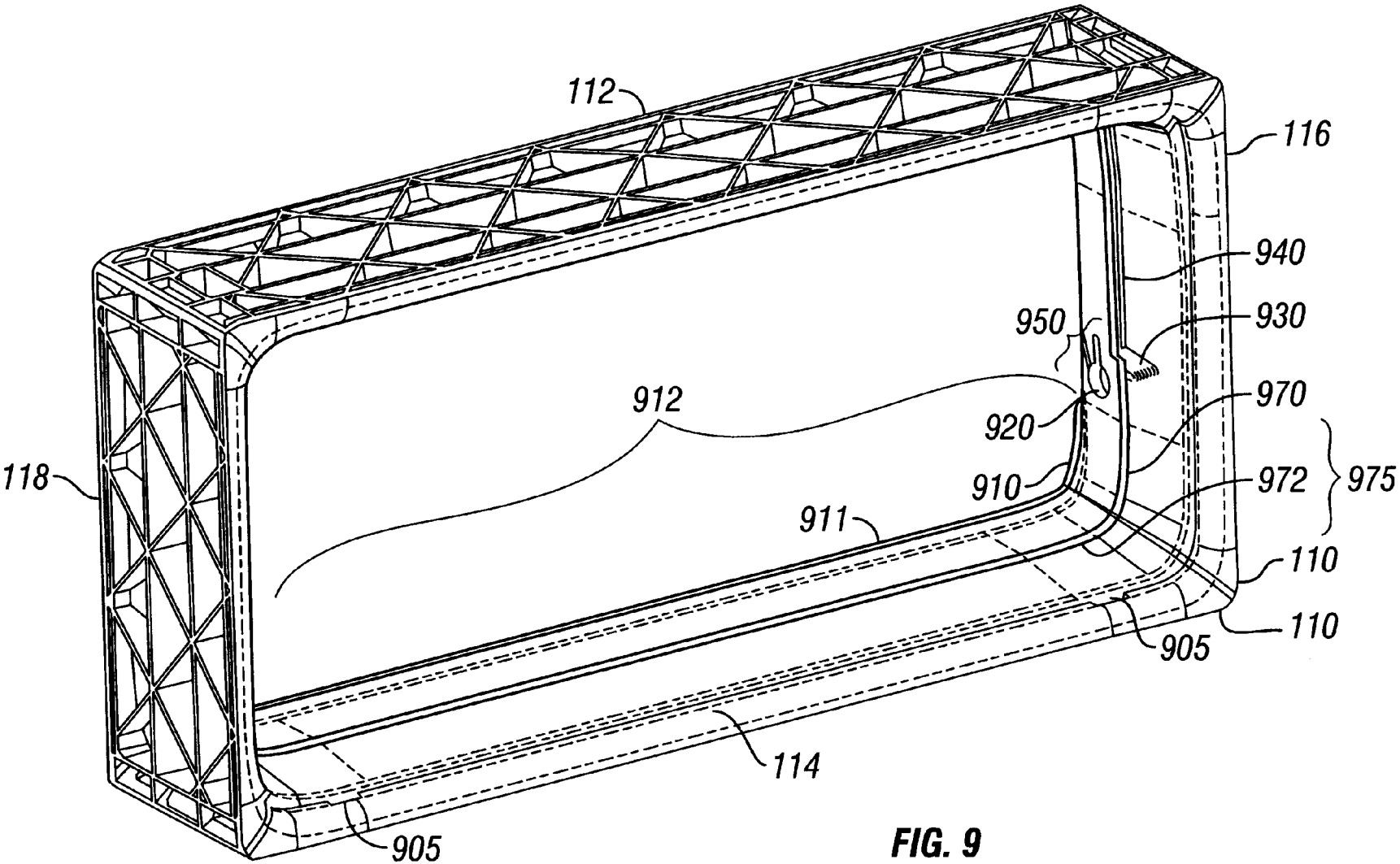
FIG. 9 illustrates an exterior view of the frame of the hopper vent according to a preferred embodiment of the present invention.

FIG. 9 illustrates an exterior view of the frame 110 of the hopper vent 100 according to a preferred embodiment of the present invention. As described above, the frame 110 includes the top frame element 112, the bottom frame element 114, the left side frame element 116, and the right side frame element 118. FIG. 9 shows the frame 110 with the removable sash window 150 and the removable screen 180 removed.

The left side frame element 116 also includes a front riser seal portion 910, a pivot slot 920, a stop bar 930, a back seal portion 940, positioning slots 950, and a compression seal portion 970. The right side frame element 118 is a mirror image of the right side frame element 118 and thus also includes the front riser seal portion 910, pivot slot 920, stop bar 930, back seal portion 940, positioning slots 950, and compression seal portion 970. The bottom frame element 114 includes screen bottom tab inserts 905, a front riser seal portion 911, and a compression seal portion 972. The top frame element 112 is better shown in FIG. 10 and includes screen top tab inserts 1005, a back seal portion 1007, a locking slot 1009, and a compression seal portion 1072.

As shown in FIG. 9, the front riser seal portions 910 on the right side frame element 118 and the left side frame element 116 and the front riser seal portion 911 on the bottom frame element 114 form a front riser seal 912. The front riser seal 912 prevents water or other liquid that enters the hopper vent 100 from draining into the inside of the hopper vent, for example, into the interior of a structure. That is, water, such as rain water, may enter the hopper vent 100, for example, by passing through the removable screen 180. The water entering the hopper vent 100 may accumulate to some degree, but is prevented from draining into the structure by the front riser seal 912. In addition, the bottom frame element 114 is preferably slanted downwardly away from the front riser seal 912, so that water may drain out of the hopper vent 100, for example, through the weep holes 815 of the removable screen 180 as described above.

The right side frame element 118 and the left side frame element 116 also each include a pivot slot 920. In practice, both pivot slots 920 receive the pivot nubs 610 of the window pivots 410 of the removable sash window 150, as described above. That is, the removable sash window 150 is affixed to the frame 110 by introducing the pivot nubs 610 into the pivot slots 920. As described above, the pivot slots 920 allow the pivot nubs 610 to rotate to allow the removable sash window 150 to be opened and closed.

Additionally, the right side frame element 118 and the left side frame element 116 also each include positioning slots 950. As described above, the positioning slots 950 operate to hold the removable sash window 150 open in a fixed position. The positioning slots 950 receive the positioning nubs 620 of the window pivots 410 of the removable sash window 150. As described above, the positioning nubs 620 are biased into the positioning slots 950 and hold the removable sash window 150 open in a predetermined position. When the user wishes to change the position of the removable sash window 150, the user may apply force to the removable sash window 150. When the force applied by the user overcomes the force biasing the positioning nubs 620 into the positioning slots 950, the positioning nubs 620 emerge from the positioning slots 950 and the removable sash window 150 pivots.

The right side frame element 118 and the left side frame element 116 also each include the stop bar 930. The stop bar 930 stops the pivoting of the removable sash window 150 at its fully open position, as shown in FIG. 1. That is, the exterior edge of the removable sash window 150 pivots into contact with the stop bar 930, and the stop bar 930 prevents further pivotal motion. The removable sash window 150 may be adjusted to any partially open positions between fully closed and fully open, including the several predetermined positions provided by the positioning slots 950 to hold the removable sash window's 150 position.

Also, the right side frame element 118 and the left side frame element 116 each include the back seal portion 940. As more clearly shown in FIG. 10, the back seal portions 940 on the right side frame element 118 and the left side frame element 116 and the back seal portion 1007 on the top frame element 112 form a back seal 1012. The back seal 1012 forms a seal between the exterior top edge of the removable sash window 150 when the removable sash window 150 is pivoted to its closed position as illustrated in FIG. 2. The front riser seal 912 and the back seal 1012 provide for a complete seal around substantially the entire perimeter of the removable sash window 150.

As mentioned above, the bottom frame element 114 includes the screen bottom tab inserts 905 and the top frame element 112 includes the screen top tab inserts 1005. As mentioned above, the screen bottom tab inserts 905 receive the screen bottom tabs 805 of the removable screen 180 while the screen top tab inserts 1005 receive the screen top tabs 810. The tabs 805, 810 and tab inserts 905, 1005 cooperate to fasten the removable screen 180 to the frame 110.

Additionally, the top frame element 112 includes the locking slot 1009. As mentioned above, the locking slot 1009 provides for locking the removable sash window 150 in its closed position. That is, when the removable sash window 150 is in its closed position, the user fob 420 is rotated, thus extending the locking latch 720 into the locking slot 1009 and thus locking the removable sash window 150 in its closed position.

As shown in FIGS. 9 and 10, the compression seal portions 970 on the right side frame element 118 and the left side frame element 116, the compression seal portion 972 on the bottom frame element 114, and the compression seal portion 1072 on the top frame element 112 cooperate to form a compression seal 975. The compression seal 975 extends completely around the inside perimeter of the frame 110 as shown. As described above, the compression seal 975 is introduced into the window seal groove 475 of the removable sash window 150 when the removable sash window 150 is in its closed position. The compression seal 975 is comprised of a compression sealant such as foam rubber, for example. The compression seal 975 cooperates with the window seal groove 475 to completely seal the perimeter of the removable sash window 150 to the frame 110.

As further described below, the frame 110 is assembled by fastening together the top frame element 112, the bottom frame element 114, the left side frame element 116, and the right side frame element 118, preferably by snapping them together. The removable sash window 150 and the removable screen 180 may then be fastened into the frame 110 to form the complete hopper vent 100, as illustrated in FIGS. 1–3 and 11.

FIG. 10 illustrates the top frame element 112 and the left side frame element 116 according to a preferred embodiment of the present invention. FIG. 10 shows a male connection 1010 and a female connection 1020. The male connection 1010 includes an seal groove 1013, a connection member 1014 and two notched prongs 1015. The female connection 1020 includes a seal wall 1022, a connection aperture 1024, and two prong apertures 1025.

Similar to the window frame elements 262–268 described above, each of the frame elements 112–118 of the frame 110 is preferably composed of an injection molded plastic form. The individual frame elements 112–118 are joined together in four locations to form the frame 110. That is, the frame elements 112–118 are joined between 1) the top 112 and left side 116 (as shown in FIG. 10), 2) the left side 116 and bottom 114, 3) the bottom 114 and right side 118, and 4) the right side 118 and top 112. At each connection between two frame elements 112–118, one of the frame elements 112–118 includes a male connection 1010 and the other frame element 112–118 includes a female connection 1020. Each of the connections between frame elements 112–118 is substantially similar to the mechanism illustrated in FIG. 10.

To connect two frame elements 112–118, the frame elements 112–118 are snapped together. That is, the connection member 1014 and the two notched prongs 1015 of the male connection 1010 are introduced into the connection aperture 1024 and the two prong apertures 1025 of the female connection 520. As the connection member 1014 is introduced into the connection aperture 1024, the connection member 1014 engaged the interior of the connection aperture 1024. As the two notched prongs 1015 are introduced into the two prong apertures 1025, the two notched prongs 1015 engage the interior of the two prong apertures 1025. Once the connection member 1014 and the two notched prongs 1015 have engaged the connection aperture 1024 and the two prong apertures 1025, respectively, the two frame elements 112–118 have been locked together. Additionally, as the two elements 112–118 are sealed together, the seal wall 1022 of the female connection 1020 fits into the seal groove 1013 of the male connection and act to seal the frame 110, for example, to minimize the introduction of dirt or moisture into the frame 110.

Figure 11B:
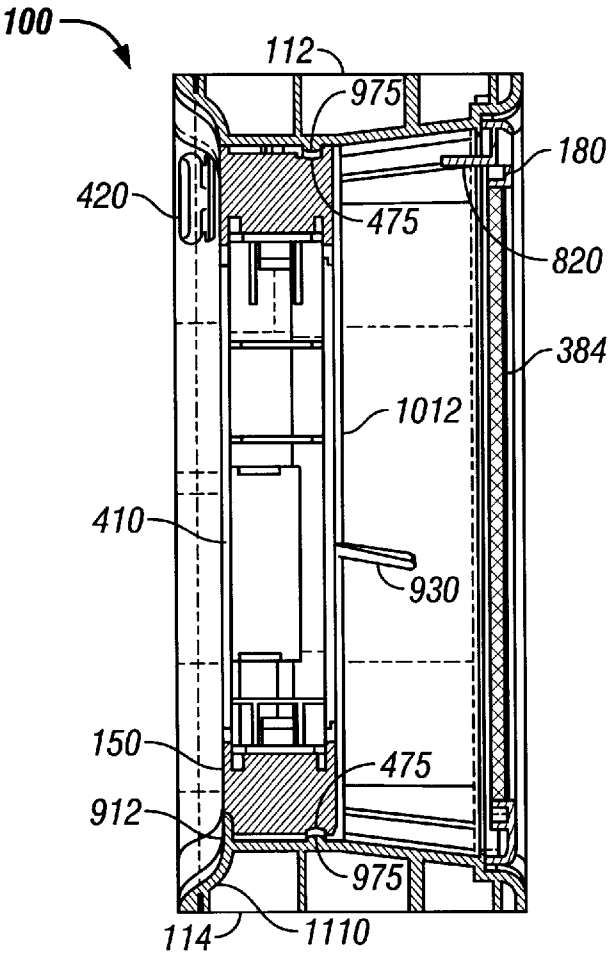
FIG. 11 illustrates a side transparent cut-away view of the hopper vent in its closed position according to a preferred embodiment of the present invention.
Figure 11A:
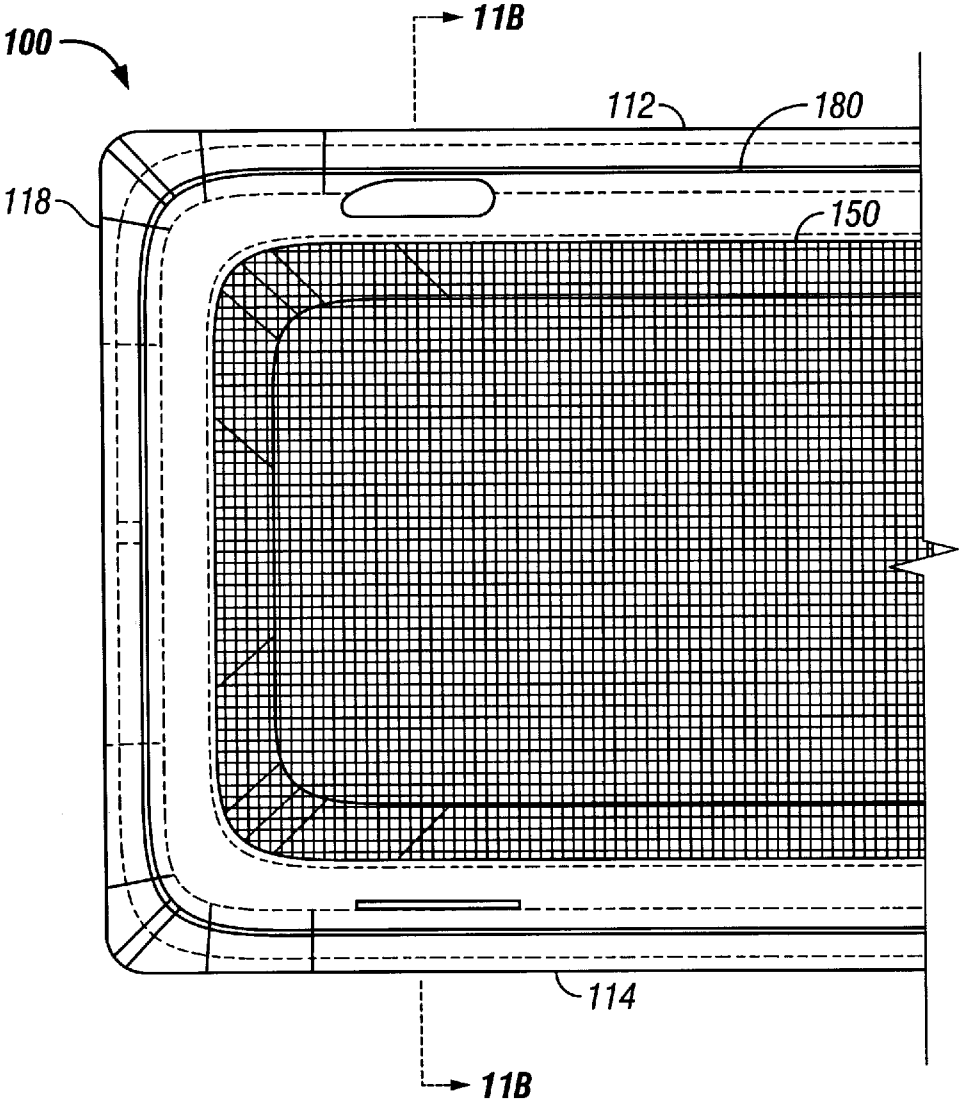

FIG. 11 illustrates a side transparent cut-away view of the hopper vent 100 in its closed position according to a preferred embodiment of the present invention. FIG. 11 shows the hopper vent 100 including the frame 110, the removable sash window 150, and the removable screen 180. The frame 110 also includes the top frame element 112, the bottom frame element 114, the left side frame element 116, the stop bar 930, the back seal 1012, the front seal 912, and the compression seal 975. The removable sash window 150 also includes the window pivot 410, the rotating user fob 420, and the window seal groove 475. The removable screen 180 also includes the screen mesh 384 and the interior screen removal tabs 820.

FIG. 11 also shows the sloped bottom interior edge 1110 of the bottom frame element 114, as also shown in FIG. 1. The sloped bottom interior edge 1110 of the bottom frame element 114 aids in preventing accumulation, for example of dirt or dust, on the bottom frame element 114, and may make the hopper vent more aesthetically appealing.

As illustrated above with reference to FIGS. 1–11, a preferred embodiment of the present invention includes many novel elements. For example, first, the removable interior sash window 150 is removable. Also, the removable sash window 150 is removable from the interior side of the hopper vent 100. Additionally, the removable interior sash window 150 is injection molded and is spring loaded into the frame 110 by the bias springs 640. Second, the removable sash window 150 employs the window pivot 410 to pivot open, instead of employing a hinge system to rotate open. Third, the removable screen 180 is removable. Also, the removable screen 180 is removable from the interior side of the hopper vent 100. Fourth, the hopper vent 100 includes a dam system including a front riser seal 912 at the inside edge of the bottom frame element 114 to prevent water from draining to the interior of the hopper vent 100 and weep holes 815 to allow water to drain to the exterior of the hopper vent 100. Fifth, the removable sash window 150 is dual sealing. That is, when the removable sash window 150 is in its closed position, the top, exterior edge of the removable sash window 150 seals to the back seal 940 and the bottom, interior edge of the removable sash window 150 seals to the front riser seal 912. Sixth, the removable sash window 150 includes a compete perimeter seal between it and the frame 110. That is, the removable sash window 150, when in its closed position, cooperates with the compression seal 975 of the frame 110 to completely seal the removable sash window 150 to the frame 110. Seventh, the removable sash window 150 may be opened and fixedly positioned at any of several predetermined positions. That is, the positioning nub 620 of the removable sash window 150 and the positioning slots 950 of the frame 110 cooperate to hold the removable sash window 150 at any of several predetermined locations. Eighth, the frame 110 includes a sloped interior ledge to prevent the accumulation of dirt and to provide for easy cleaning. Ninth, the removable interior sash window 150 also includes the window lock 155 recessed within the window frame 260. That is, the window lock 155 is fashioned as part of the removable sash window 150, instead of being merely attached to the frame 110. Tenth, the hopper vent 100 may be injection molded and may simply snap together for easy manufacture and assembly. Eleventh, the frame elements 112–118 and window frame elements 262–268 include interlocking seals to provide improved element sealing.

While particular elements, embodiments and applications of the present invention have been shown and described, it is understood that the invention is not limited thereto since modifications may be made by those skilled in the art, particularly in light of the foregoing teaching. It is therefore contemplated by the appended claims to cover such modifications and incorporate those features which come within the spirit and scope of the invention.

What is claimed is:

1. A hopper vent including:

a transparent insert;

a window frame forming a central opening containing said transparent insert, said window frame including a pivot; and a frame forming a central opening containing said window frame and including a pivot insert aperture, wherein said window frame is directly removable from said frame and said pivot is inserted into said pivot insert aperture to install said window frame into said frame;

wherein said pivot includes a base plate having secured thereto a pivot bias spring to bias said pivot so that said pivot is movable relative to said window frame;

wherein said base plate includes an installment notch, said installment notch securing said base plate within a recess within said window frame whereby said spring biases said plate to an engage or disengage position.

2. The hopper vent of claim 1 wherein said hopper vent includes a user-actuatable discharge that does not require tools to remove said window frame from said frame.

3. The hopper vent of claim 1 wherein said hopper vent has an interior side and an exterior side and said window frame is removable from the interior side of said hopper vent.

4. The hopper vent of claim 1 wherein said window frame is spring loaded by bias springs into said frame.

5. A method for removing a window frame from a hopper vent, said method including the step of:

actuating a user-actuatable discharge, wherein said window frame includes a pivot and forms a central opening containing a transparent insert and said frame forms a central opening containing said window frame and said window frame is directly removable from said frame and wherein said pivot is inserted into a pivot insert aperture in said frame to install said window frame into said frame;

wherein said pivot includes a base plate having secured thereto a pivot bias spring to bias said pivot so that said pivot is movable relative to said window frame;

wherein said base plate includes an installment notch, said installment notch securing said base plate within a recess within said window frame whereby said spring biases said plate to an engage or disengage position.

6. A hopper vent including:

a window frame forming a central opening containing a transparent insert and also including at least one pivot; and a frame forming a central opening containing said window frame, wherein said window frame is affixed to said frame by inserting said at least one pivot into at least one pivot insert aperture in said frame and permitting the window frame to be opened;

wherein said at least one pivot includes a base plate having secured thereto a pivot bias spring to bias said pivot so that said pivot is movable relative to said window frame;

wherein said base plate includes an installment notch, said installment notch securing said base plate within a recess within said window frame whereby said spring biases said plate to an engage or disengage position.

7. The hopper vent of claim 6 wherein said window frame is spring loaded by bias springs into said frame.

8. The hopper vent of claim 6 wherein said window frame may be pivoted open and fixedly positioned at a plurality of predetermined positions.

9. The hopper vent of claim 8 wherein said window frame is fixedly positioned at said predetermined positions by spring compressing force.

10. The hopper vent of claim 8 wherein said window frame further includes at least one positioning nub and said frame further includes at least one positioning slot.

11. The hopper vent of claim 10 further including a bias spring wherein said positioning nub is introduced into said positioning slot by said bias spring.

12. A method for opening a window frame of a hopper vent including the step of:

pivoting the window frame open using a pivot system, said pivot system affixing said window frame to a frame forming a central opening containing said frame, said pivot rotating about a single axis of rotation without lateral displacement to open said window frame, wherein said window frame is directly removable from said frame;

wherein said pivot system includes a base plate having secured thereto a pivot bias spring to bias said pivot so that said pivot is movable relative to said window frame;

wherein said base plate includes an installment notch, said installment notch securing said base plate within a recess within said window frame whereby said spring biases said plate to an engage or disengage position.

13. A hopper vent including:

a window frame having at least one retractable pivot and forming a central opening containing a transparent insert; and a frame forming a central opening containing said window frame wherein said window frame is installable in said frame by inserting said at least one retractable pivot into at least one pivot insert aperture in said frame;

wherein said at least one pivot includes a base plate having secured thereto a pivot bias spring to bias said pivot so that said pivot is movable relative to said window frame;

wherein said base plate includes an installment notch, said installment notch securing said base plate within a recess within said window frame whereby said spring biases said plate to an engage or disengage position.

14. A hopper vent including:

a window frame including at least one retractable pivot; and a frame forming a central opening containing said window frame, wherein said window frame is affixed to said frame by a inserting said at least one retractable pivot into at least one pivot insert aperture in said frame;

wherein said at least one pivot includes a base plate having secured thereto a pivot bias spring to bias said pivot so that said pivot is movable relative to said window frame;

wherein said base plate includes an installment notch, said installment notch securing said base plate within a recess within said window frame whereby said spring biases said plate to an engage or disengage position.

* * * * *